US012729502B2

(12) United States Patent
Yamawaki

(10) Patent No.: US 12,729,502 B2
(45) Date of Patent: Sep. 8, 2026

(54) WORK MACHINE AND CONTROL METHOD FOR WORK MACHINE

(71) Applicant: KOMATSU LTD., Tokyo (JP)

(72) Inventor: Shota Yamawaki, Tokyo (JP)

(73) Assignee: KOMATSU LTD., Tokyo (JP)

( * ) Notice: Subject to any disclaimer, the term of this patent is extended or adjusted under 35 U.S.C. 154(b) by 428 days.

(21) Appl. No.: 17/802,996

(22) PCT Filed: Mar. 18, 2021

(86) PCT No.: PCT/JP2021/010968

§ 371 (c)(1),
(2) Date: Aug. 29, 2022

(87) PCT Pub. No.: WO2021/193321

PCT Pub. Date: Sep. 30, 2021

(65) Prior Publication Data

US 2023/0129066 A1 Apr. 27, 2023

(30) Foreign Application Priority Data

Mar. 26, 2020 (JP) ..... 2020-055990

(51) Int. Cl.
*E02F 3/43* (2006.01)
*E02F 3/38* (2006.01)

(52) U.S. Cl.
CPC ..... *E02F 3/432* (2013.01); *E02F 3/38* (2013.01)

(58) Field of Classification Search
CPC ..... E02F 3/432; E02F 9/0841; E02F 3/433; E02F 3/38
USPC ..... 701/50
See application file for complete search history.

(56) References Cited

U.S. PATENT DOCUMENTS 5,188,502 A * 2/1993 Tonsor ..... E02F 3/433 414/700
5,704,429 A 1/1998 Lee et al.
2004/0136821 A1* 7/2004 Berger ..... E02F 3/433 414/699

(Continued)

FOREIGN PATENT DOCUMENTS

CN 2564518 Y 8/2003
CN 201007008 Y 1/2008

(Continued)

OTHER PUBLICATIONS

The International Search Report for the corresponding international application No. PCT/JP2021/010968, issued on Jun. 15, 2021.

(Continued)

*Primary Examiner* — Abby J Flynn
*Assistant Examiner* — Leah N Miller
(74) *Attorney, Agent, or Firm* — Spencer Fane LLP

(57) ABSTRACT

A wheel loader includes a vehicle body, a work implement, a bucket-to-ground angle detection section, and a control section. The work implement operates with respect to the vehicle body and includes a bucket or a fork. The bucket-to-ground angle detection section detects information on a tilt angle of the bucket or the fork with respect to a gravity direction. The control section controls the tilt angle of the bucket or the fork with respect to the gravity direction based on a detection value of the bucket-to-ground angle detection section.

6 Claims, 10 Drawing Sheets

(56) References Cited

U.S. PATENT DOCUMENTS

| | | | | |
|---|---|---|---|---|
| 2008/0005938 | A1 | 1/2008 | Aebischer et al. | |
| 2014/0129093 | A1* | 5/2014 | Shirao | E02F 3/433 701/50 |
| 2015/0284931 | A1 | 10/2015 | Tsukamoto | |
| 2015/0337877 | A1 | 11/2015 | Miyamoto et al. | |
| 2016/0312434 | A1 | 10/2016 | Shintani et al. | |
| 2017/0036899 | A1* | 2/2017 | Singh | E02F 3/433 |
| 2017/0037594 | A1 | 2/2017 | Wada et al. | |
| 2017/0107688 | A1 | 4/2017 | Fujii et al. | |
| 2017/0167116 | A1 | 6/2017 | Fujii et al. | |
| 2018/0016768 | A1 | 1/2018 | Izumikawa | |
| 2018/0119384 | A1 | 5/2018 | Imaizumi et al. | |
| 2019/0226181 | A1 | 7/2019 | Imura et al. | |
| 2019/0338489 | A1 | 11/2019 | Yamanaka et al. | |
| 2019/0369639 | A1 | 12/2019 | Yamamura et al. | |
| 2020/0040548 | A1 | 2/2020 | Shimizu et al. | |

FOREIGN PATENT DOCUMENTS

| | | | | |
|---|---|---|---|---|
| CN | 101705698 | A | | 5/2010 |
| CN | 102418353 | A | | 4/2012 |
| CN | 103103997 | A | | 5/2013 |
| CN | 103615025 | A | | 3/2014 |
| CN | 104918835 | A | | 9/2015 |
| CN | 105829616 | A | | 8/2016 |
| CN | 106574455 | A | | 4/2017 |
| CN | 106856661 | A | | 6/2017 |
| CN | 107130660 | A | | 9/2017 |
| CN | 107250461 | A | | 10/2017 |
| CN | 107407065 | A | | 11/2017 |
| CN | 108055855 | A | | 5/2018 |
| CN | 110300940 | A | | 10/2019 |
| DE | 101 15 678 | C1 | | 11/2002 |
| GB | 1034672 | A | | 6/1966 |
| GB | 8921181 | | | 11/1989 |
| JP | H01239231 | A | * | 9/1989 |
| JP | 11-286970 | A | | 10/1999 |
| JP | 2001-55762 | A | | 2/2001 |
| JP | 2011179180 | A | * | 9/2011 |
| JP | 2013-110945 | A | | 6/2013 |
| JP | 2018-135649 | A | | 8/2018 |
| JP | 2018-135679 | A | | 8/2018 |
| JP | 2018-168573 | A | | 11/2018 |
| JP | 2019-15176 | A | | 1/2019 |
| JP | 2019-49150 | A | | 3/2019 |
| JP | 2019049150 | A | * | 3/2019 |

OTHER PUBLICATIONS

The extended European search report for the corresponding European application No. 21776835.7, issued on Mar. 18, 2024.

The Office Action for the corresponding Chinese application No. 202180016292.6, issued on Feb. 4, 2024.

Wang Jin-feng, Dynamic Simulation of Loader Working Device published by China Academic Journal Electronic Publishing House; Agricultural Equipment & Vehicle Engineering (No. 9; 2009; Totally 218; China).

Tao Lin-yu et al., Research on automatic bucket leveling algorithm of loader angular displacement system published by China Academic Journal Electronic Publishing House; Construction Machinery (Dec. 2014; China).

* cited by examiner

WORK MACHINE AND CONTROL METHOD FOR WORK MACHINE

CROSS-REFERENCE TO RELATED APPLICATIONS

This application is a U.S. National stage application of International Application No. PCT/JP2021/010968, filed on Mar. 18, 2021. This U.S. National stage application claims priority under 35 U.S.C. § 119(a) to Japanese Patent Application No. 2020-055990, filed in Japan on Mar. 26, 2020, the entire contents of which are hereby incorporated herein by reference.

TECHNICAL FIELD

The present invention relates to a work machine and a control method for a work machine.

BACKGROUND INFORMATION

A wheel loader is responsible for a dumping operation. It lifts a boom to raise a bucket and rotates the bucket to load the earth and sand.

In a loading state, it is desired that an angle of the bucket with respect to a ground is maintained when the boom is raised in order to prevent the load from falling. However, since the boom is a link in the rotary link mechanism, raising the boom structurally causes the angle of the bucket to change. For this reason, a parallel link control is employed so that the angle of the bucket is adjusted according to the operation of the boom and the angle of the bucket is maintained.

In some wheel loaders, a fork is attachable instead of the bucket for forklifting work. In this case, the parallel link control is executed so that the angle of the fork is maintained (for example, see U.S. Pat. No. 5,188,502).

SUMMARY

However, since a work machine in U.S. Pat. No. 5,188,502 executes the parallel link control using the vehicle body as a reference, the angle of the bucket may not be maintained when the boom is raised, with the vehicle body disposed on a ground surface that is inclined.

An object of the present disclosure is to provide a work machine and a control method for a work machine capable of maintaining an angle of an attachment even when the work machine is in a tilted state.

A work machine according to a first aspect includes a body, a work implement, an attachment tilt angle detection section, and a control section. The work implement operates with respect to the body and includes an attachment. The attachment tilt angle detection section detects a tilt angle of the attachment with respect to a gravity direction. The control section controls the tilt angle of the attachment with respect to the gravity direction based on a detection value of the attachment tilt angle detection section.

A control method for a work machine according to a second aspect is a control method for a work machine that includes a body and a work implement operating with respect to the body and having an attachment, and the control method includes an attachment tilt angle detection step and a control step. The attachment tilt angle detection step detects a tilt angle of the attachment with respect to a gravity direction. The control step controls the tilt angle of the attachment with respect to the gravity direction based on a detection value in the attachment tilt angle detection step.

According to the present disclosure, it is possible to provide the work machine and the control method for the work machine capable of maintaining the angle of the attachment even when the work machine is in the tilted state.

DESCRIPTION OF EMBODIMENTS

A wheel loader as an example of a work machine according to the present disclosure will be described with reference to the drawings.

First Embodiment

The wheel loader according to a first embodiment will be described below.

<Configuration>

(Overview of Wheel Loader)

Figure 1:
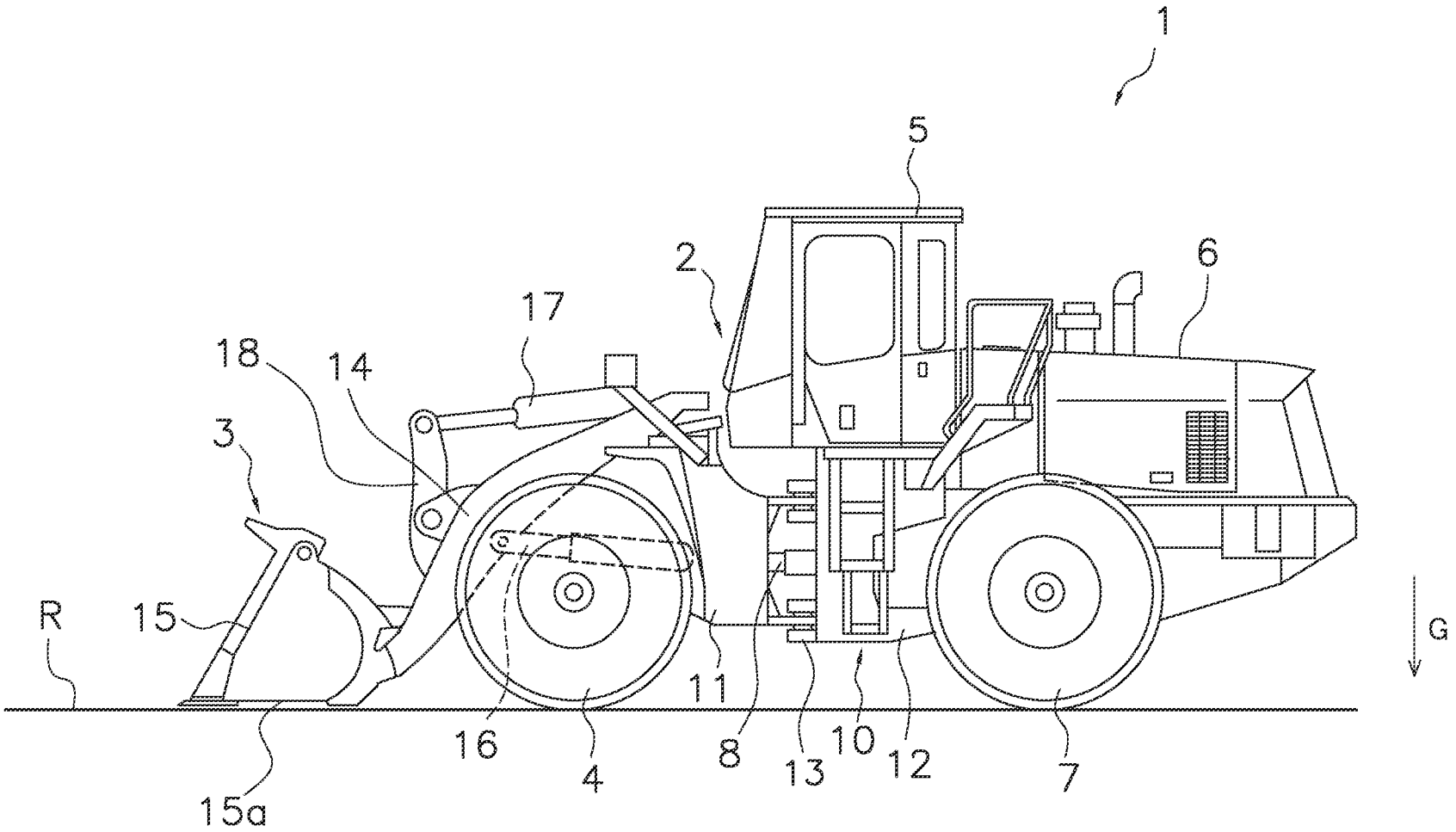
FIG. 1 is a side view of a wheel loader in a first embodiment according to the present disclosure.

FIG. 1 is a schematic view illustrating a configuration of a wheel loader 1 in the present embodiment.

The wheel loader 1 (an example of a work machine) in the present embodiment includes a vehicle body 2 (an example of a body) and a work implement 3. The vehicle body 2 includes a vehicle body frame 10, a pair of front tires 4, a cab 5, an engine room 6, a pair of rear tires 7, a pair of steering cylinders 8, a control section 9 (see FIG. 6), and a bucket-to-ground angle detection section 20 (an example of an attachment tilt angle detection section) (see FIG. 6) and an operation section 50 (see FIG. 6).

The wheel loader 1 performs work, such as loading earth and sand, with the work implement 3.

The vehicle body frame 10 is a so-called articulated type and includes a front frame 11, a rear frame 12, and a coupling shaft portion 13. The front frame 11 is disposed in front of the rear frame 12. The coupling shaft portion 13 is provided at the center in the vehicle width direction and couples the front frame 11 and the rear frame 12 so as to be swingable with each other.

The pair of steering cylinders 8 is driven by hydraulic pressure. The steering cylinders 8 as the pair are disposed adjacent to each other at the left and right sides in the vehicle width direction with the coupling shaft portion 13 in between. One end of each of the steering cylinders 8 is attached to the front frame 11 and the other end of each of the steering cylinders 8 is attached to the rear frame 12.

The cab 5 is provided on the rear frame 12 and an operator's seat is disposed in the cab 5. The engine room 6 is disposed behind the cab 5 and houses the engine and the like.

The front tires 4 as the pair are attached to the left and right sides of the front frame 11. The rear tires 7 as the pair are attached to the left and right sides of the rear frame 12.

The work implement 3 is driven by hydraulic fluid from a work implement pump. The bucket-to-ground angle detection section 20 detects information on a tilt angle of a bucket 15 of the work implement 3 with respect to a gravity direction G and transmits a detection value to the control section 9. The control section 9 executes a ground-reference control (described later) for the bucket 15 based on the detection value. The operation section 50 is set by an operator to execute the ground-reference control.

(Work Implement 3)

Figure 2:
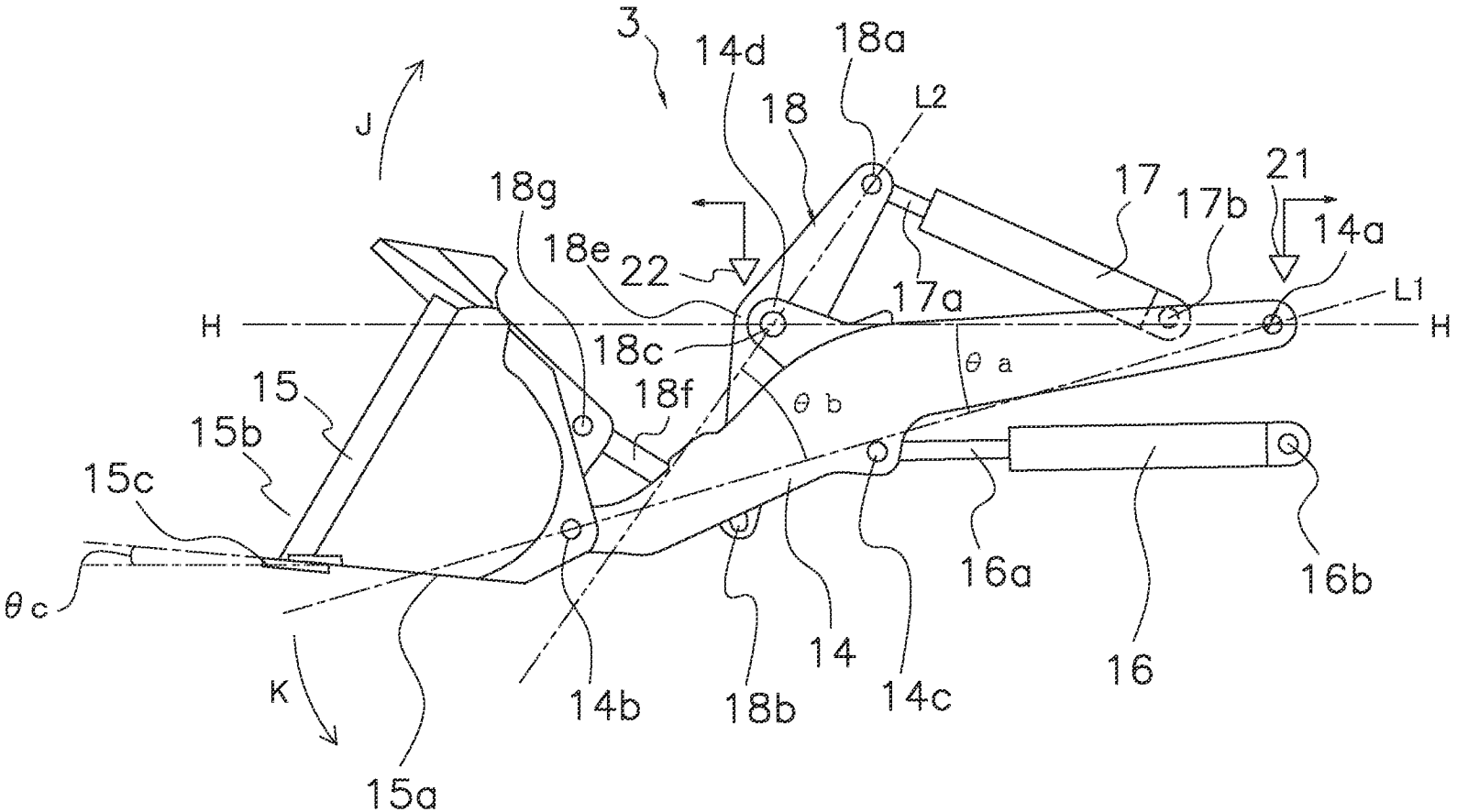
FIG. 2 is a side view of a work implement of the wheel loader of FIG. 1.

FIG. 2 is an enlarged side view of the work implement 3.

The work implement 3 includes a boom 14, a bucket 15 (an example of an attachment), a boom cylinder 16, a bucket cylinder 17, and a bell crank 18.

An attachment portion 14*a* provided at one end of the boom 14 is rotatably attached to a front portion of the front frame 11. An attachment portion 14*b* provided at the other end of the boom 14 is rotatably attached to a rear portion of the bucket 15. A tip of a cylinder rod 16*a* of the boom cylinder 16 is rotatably attached to an attachment portion 14*c* provided between the attachment portion 14*a* and the attachment portion 14*b* of the boom 14. A cylinder body of the boom cylinder 16 is rotatably attached to the front frame 11 at the attachment portion 16*b*.

The bell crank 18 includes a bell crank body 18*e* and a rod 18*f*. An attachment portion 18*a* provided at one end of the bell crank body 18*e* is rotatably attached to a tip of a cylinder rod 17*a* of the bucket cylinder 17. One end of the rod 18*f* is rotatably attached to an attachment portion 18*b* provided at the other end of the bell crank body 18*e*. The other end of the rod 18*f* is rotatably attached to a rear portion of the bucket 15 at an attachment portion 18*g*. The bell crank body 18*e* is rotatably supported by a bell crank support 14*d* in a vicinity of the center of the boom 14 at an attachment portion 18*c* provided between the attachment portion 18*a* and the attachment portion 18*b*. A cylinder body of the bucket cylinder 17 is rotatably attached to the front frame 11 at an attachment portion 17*b*. The extension and contraction force of the bucket cylinder 17 is converted into rotational motion by the bell crank 18 and transmitted to the bucket 15.

Due to the extension and contraction of the bucket cylinder 17, the bucket 15 rotates with respect to the boom 14 to perform a tilting operation (see arrow J) and a dumping operation (see arrow K). The bucket 15 includes a bottom surface 15*a*. The bottom surface 15*a* extends forward from a lower side of the attachment portion 14*b*. A claw 15*c* is disposed on a tip of the bottom surface 15*a*. Here, the tilting operation of the bucket 15 is an operation in which an opening 15*b* and the claw 15*c* of the bucket 15 rotate toward the cab 5 to tilt. In contrast with the tilting operation, the dumping operation of the bucket 15 is an operation in which the opening 15*b* and the claw 15*c* of the bucket 15 rotate so as to move away from the cab 5 to tilt.

Figure 3:
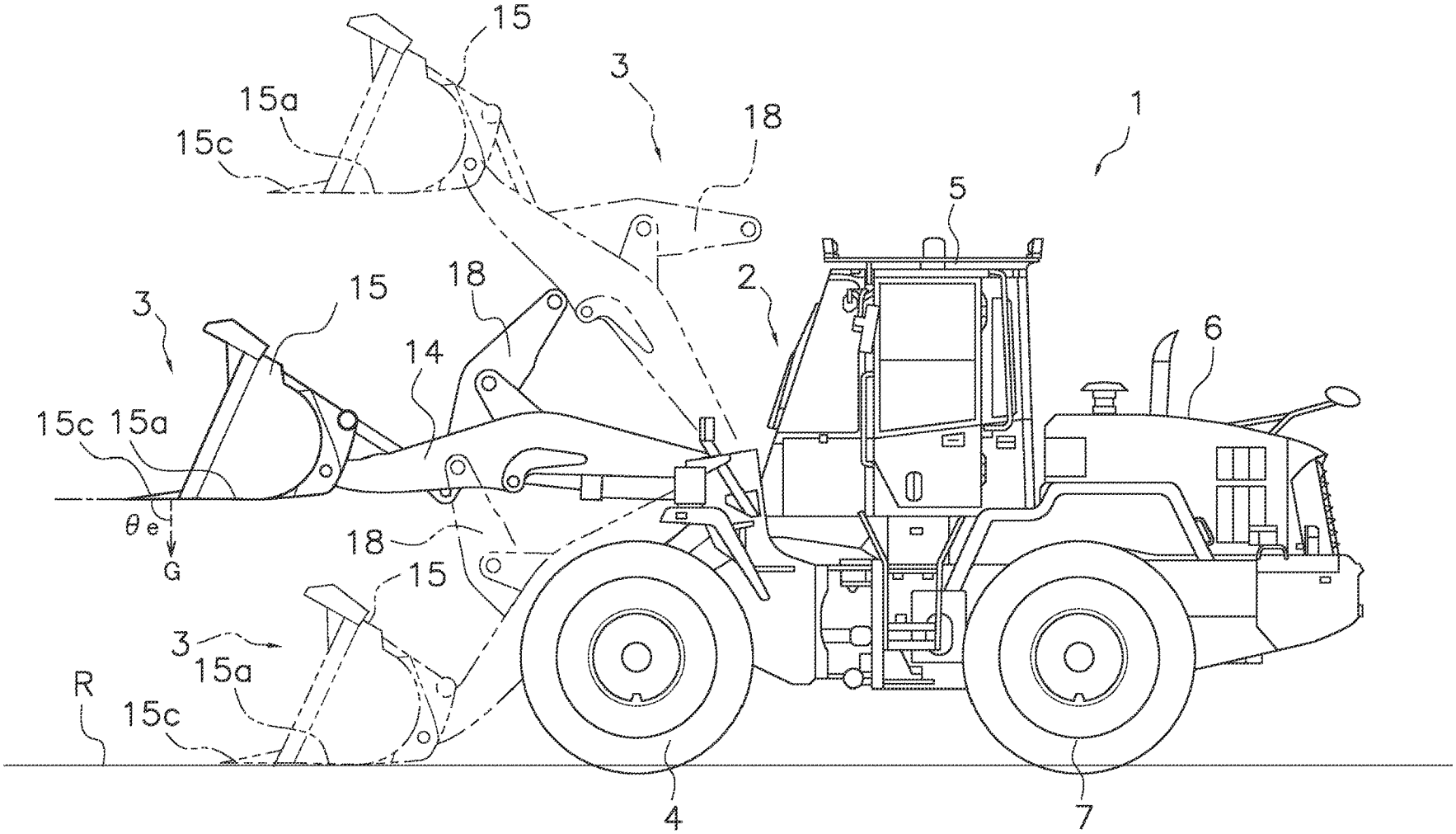
FIG. 3 is a side view illustrating a control of the work implement with the wheel loader of FIG. 1 in a horizontal state.

In the wheel loader 1 of the present embodiment, as illustrated in FIG. 3, it is possible to execute a control such that the bucket 15 is maintained at a predetermined tilt angle θe with respect to the gravity direction G (ground-reference control) when the boom is moved up and down due to an operation of an operation lever in the cab 5. In FIG. 3, the bucket 15 positioned at an upper position and the bucket 15 positioned at a lower position are illustrated by a chain double-dashed line. A tilt angle of the bucket 15 with respect to the gravity direction G (bucket-to-ground angle) is, for example, the angle between the claw 15*c* and the gravity direction G. In FIG. 3, the bucket-to-ground angle is 90 degrees and the claw 15*c* faces the horizontal direction.

Figure 4:
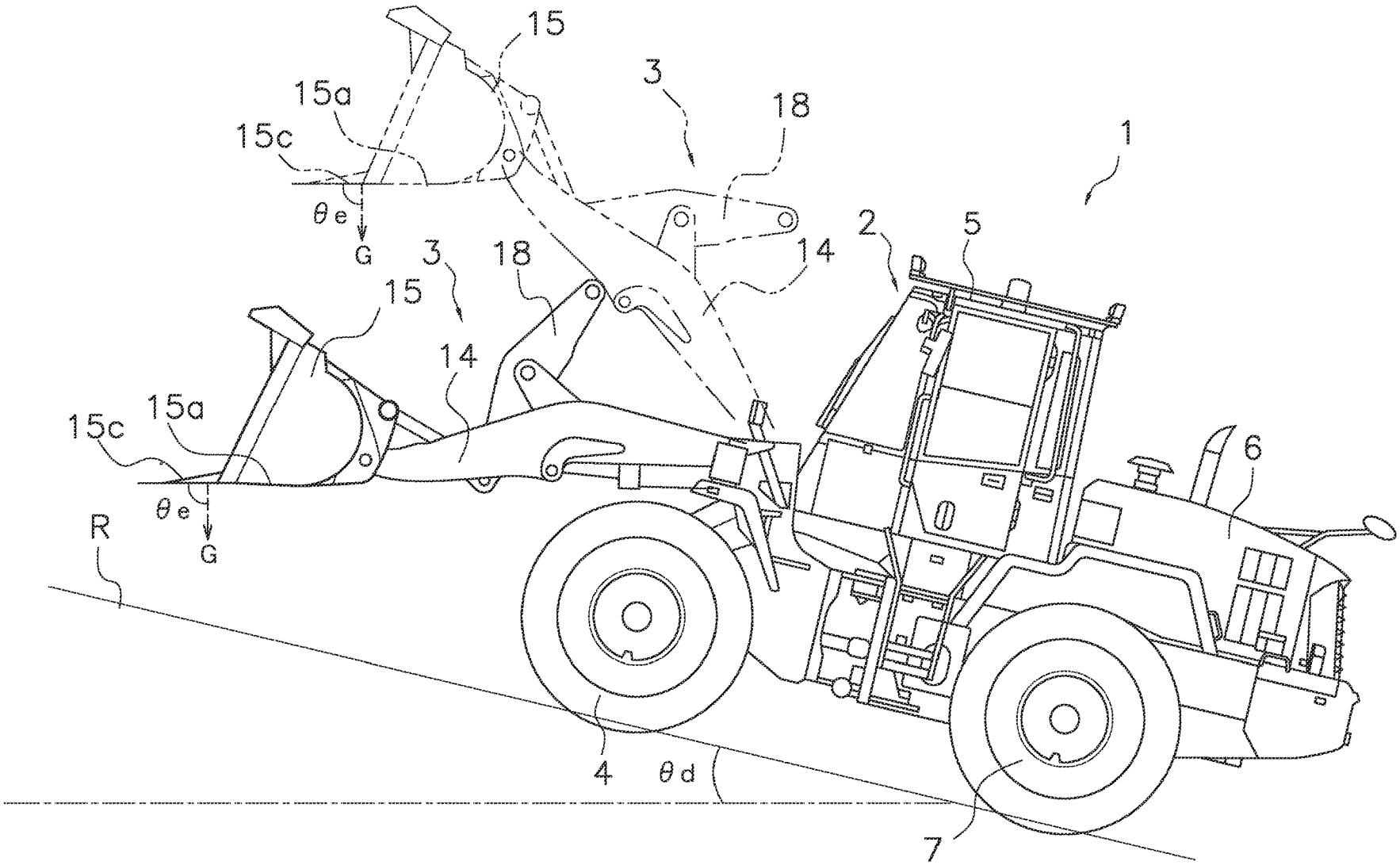
FIG. 4 is a side view illustrating a control of the work implement with the wheel loader of FIG. 1 in a tilted state.

In FIG. 3, the wheel loader 1 is disposed on a road surface R that is horizontal. However, as illustrated in FIG. 4, the wheel loader 1 in the present embodiment can execute the ground-reference control such that the bucket 15 is maintained at the predetermined tilt angle with respect to the gravity direction G when moving the boom 14 up and down even in a case where the wheel loader 1 is disposed on a road surface R that is inclined.

Figure 5:
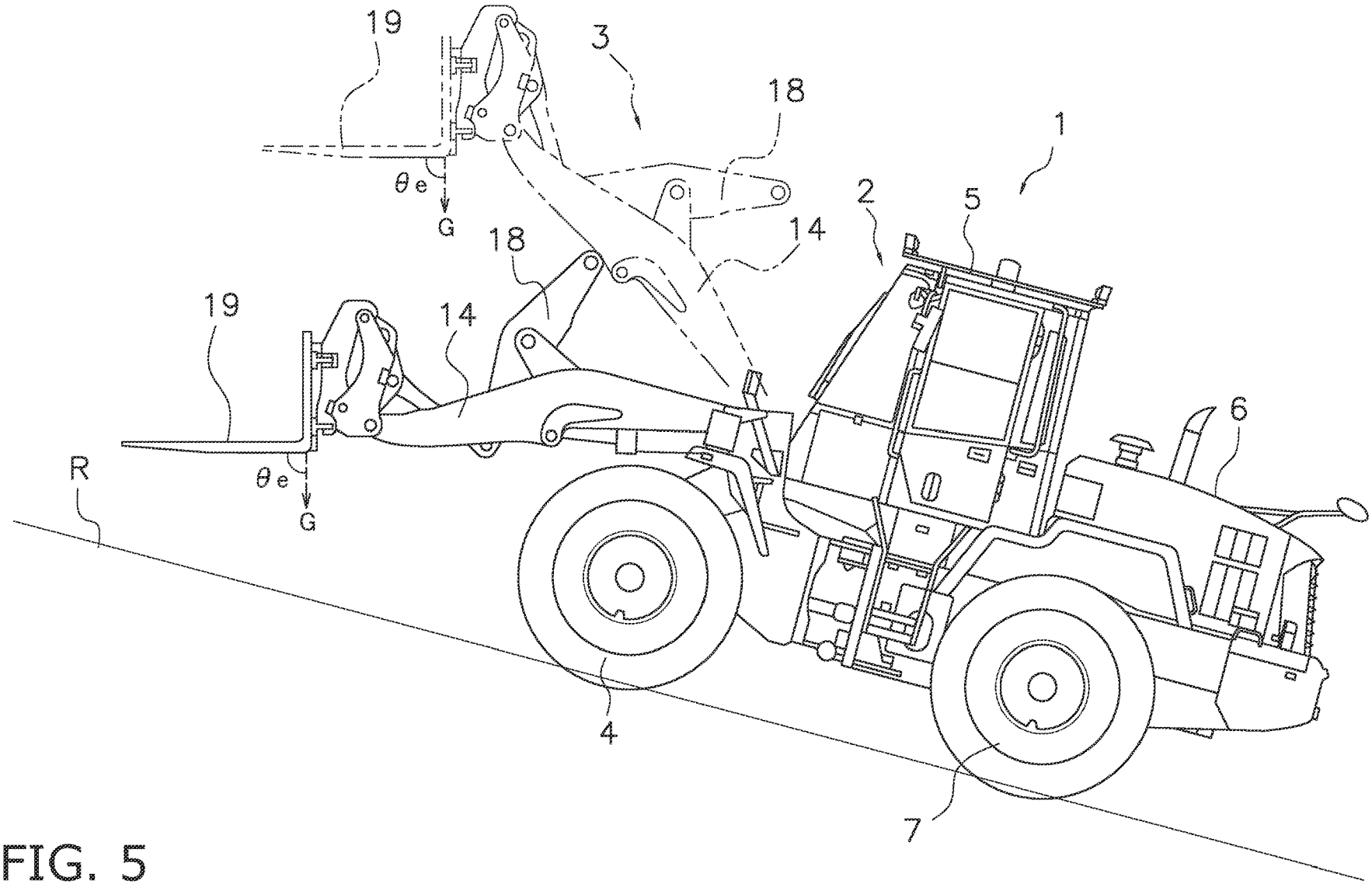
FIG. 5 is a side view illustrating a state where a fork is attached to the wheel loader of FIG. 1 instead of a bucket.

As illustrated in FIG. 5, a fork 19 can be attached to the wheel loader 1 instead of the bucket 15. The fork 19 is attached at the attachment portion 14*b* and the attachment portion 18*g* illustrated in FIG. 2. As illustrated in FIG. 5, the fork 19 can be maintained in a horizontal state where the fork is tilted by 90 degrees with respect to the gravity direction G (the tilt angle θe=90°) even in a case where the boom 14 is moved up and down in the tilted state.

(Bucket-to-Ground Angle Detection Section 20)

Figure 6:
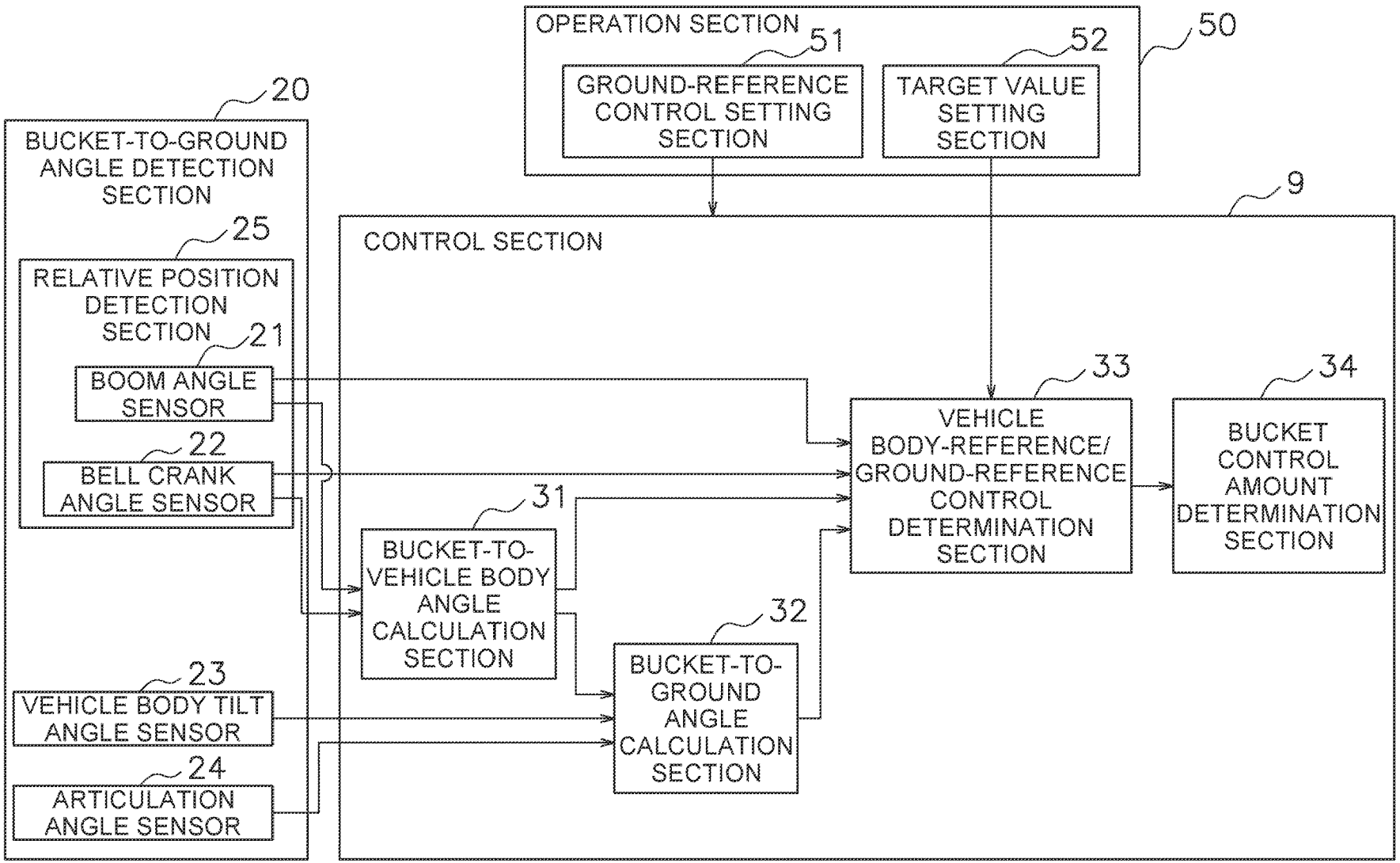
FIG. 6 is a block diagram illustrating a control configuration of the wheel loader of FIG. 1.

FIG. 6 is a block diagram illustrating a configuration of the wheel loader 1 in the present embodiment. The bucket-to-ground angle detection section 20 includes a relative position detection section 25, a vehicle body tilt angle sensor 23 (an example of a body tilt angle detection section), and an articulation angle sensor 24 (an example of a rotation angle detection section).

The relative position detection section 25 detects information on a relative position of the bucket 15 with respect to the vehicle body 2 and transmits a detection value to the control section 9.

The relative position detection section 25 includes a boom angle sensor 21 (an example of a boom angle detection section) and a bell crank angle sensor 22 (an example of an attachment angle detection section).

The boom angle sensor 21 is provided at the attachment portion 14*a* of the boom 14. A potentiometer, for example, can be used as the boom angle sensor 21. The boom angle sensor 21 detects, as a voltage value, a boom angle between a center line L1 of the boom 14 and a horizontal line H (indicated by Oa in the figure) and outputs a detection voltage. The center line L1 of the boom 14 is a line connecting the attachment portion 14*a* and the attachment portion 14*b* of the boom 14. The boom angle is a negative value when the center line L1 is tilted toward the road surface R (see FIG. 1) with respect to the horizontal line H. The detection voltage corresponds to an example of information on a tilt angle, information on a relative position, and information on a rotation angle of a boom. Further, the boom angle sensor 21 may detect the cylinder length of the boom cylinder 16 and the rotation angle of the boom 14 can be calculated from the cylinder length.

The bell crank angle sensor 22 is provided at the attachment portion 18*c* of the bell crank 18. A potentiometer, for example, can be used as the bell crank angle sensor 22. The bell crank angle sensor 22 detects, as a voltage value, a bell crank angle between a line L2 connecting the attachment portion 18*a* and the attachment portion 18*c* of the bell crank 18 and the center line L1 of the boom 14 (indicated by θb in the figure) and outputs a detection voltage. The detection voltage corresponds to an example of information on a tilt angle, information on a relative position, and information on a rotation angle of an attachment. Further, the bell crank angle sensor 22 may detect the cylinder length of the bucket cylinder 17 and the rotation angle of the bell crank 18 can be calculated from the cylinder length.

An inertial measurement unit (IMU), for example, can be used as the vehicle body tilt angle sensor 23. The vehicle body tilt angle sensor 23 detects a tilt angle of the vehicle body 2 with respect to the gravity direction G and outputs a detected tilt angle (an example of information on the tilt angle). The vehicle body tilt angle sensor 23 may be disposed on either the rear frame 12 or the front frame 11, but it is preferable to be disposed on the front frame 11 since it is not necessary to adjust an error of the tilt angle during an articulation operation in the tilted state (described later).

The articulation angle sensor 24 detects a rotation angle of the front frame 11 with respect to the rear frame 12 and outputs the rotation angle (an example of information on a tilt angle). A potentiometer can be used as the articulation angle sensor 24, but the cylinder length of the pair of steering cylinders 8 may be detected. The articulation angle can be calculated from the cylinder length of the steering cylinder 8.

(Operation Section 50)

The operation section 50 is provided inside the cab 5. As illustrated in FIG. 6, the operation section 50 includes a ground-reference control setting section 51 and a target value setting section 52. The ground-reference control setting section 51 performs the setting of the ground-reference control and the release of the ground-reference control. The ground-reference control setting section 51 includes, for example, buttons displayed on a liquid crystal panel. The ground-reference control is executed by an operator selecting an execution button. The ground-reference control is released by the operator selecting a release button. The target value setting section 52 sets a tilt angle of the bucket 15 with respect to the gravity direction G during the ground-reference control. The target value setting section 52 may be, for example, a numeric keypad displayed on the liquid crystal panel.

(Control Section 9)

The control section 9 includes a processor and a storage device. The processor is, for example, a central processing unit (CPU). Alternatively, the processor may be a processor different from the CPU. The processor executes a process for controlling the wheel loader 1 according to a program. The storage device includes a non-volatile memory, such as a read only memory (ROM), and a volatile memory, such as a random access memory (RAM). The storage device may include an auxiliary storage device, such as a hard disk drive (HDD) or a solid state drive (SSD). The storage device is an example of a non-transitory computer-readable recording medium. The storage device stores programs and data for controlling the wheel loader 1.

The detection value of the boom angle sensor 21, the detection value of the bell crank angle sensor 22, the detection value of the vehicle body tilt angle sensor 23, and the detection value of the articulation angle sensor 24 are input to the control section 9. The control section 9 executes the programs using the input detection values and the data stored in the storage device. Accordingly, the control section 9 includes the following functions.

The control section 9 includes a bucket-to-vehicle body angle calculation section 31, a bucket-to-ground angle calculation section 32, a vehicle body-reference/ground-reference control determination section 33, and a bucket control amount determination section 34.

(Bucket-to-Vehicle Body Angle Calculation Section 31)

The bucket-to-vehicle body angle calculation section 31 calculates a bucket-to-vehicle body angle that is an angle of the bucket 15 with respect to the vehicle body 2 based on the detection value of the boom angle sensor 21 and the detection value of the bell crank angle sensor 22. The bucket-to-vehicle body angle is the angle of the bucket 15 using the vehicle body 2 as a reference.

A posture of the work implement 3 is determined according to the detection value of the boom angle sensor 21 and the detection value of the bell crank angle sensor 22, whereby a relative position of the bucket 15 with respect to the vehicle body 2 can be detected. Therefore, the bucket-to-vehicle body angle of the bucket 15 can be acquired by using the detection value of the boom angle sensor 21 and the detection value of the bell crank angle sensor 22.

As the bucket-to-vehicle body angle, an angle of the bucket 15 using the vehicle body 2 as a reference may be set. For example, an angle θc between a line parallel to a line connecting two points of the vehicle body frame (preferably the front frame 11) and the claw 15*c* of the bucket 15 can be set as the bucket-to-vehicle body angle. The two points are preferably at positions where the rigidity of the vehicle body are high. For example, the attachment portion of the boom can be the point.

(Bucket-to-Ground Angle Calculation Section 32)

The bucket-to-ground angle calculation section 32 calculates a bucket-to-ground angle that is an angle of the bucket 15 with respect to the gravity direction G based on the bucket-to-vehicle body angle calculated by the bucket-to-vehicle body angle calculation section 31, the detection value of the vehicle body tilt angle sensor 23, and the detection value of the articulation angle sensor 24.

Here, in a case where the wheel loader 1 is disposed on an inclined surface and the front frame 11 is disposed linearly with respect to the rear frame 12, a tilt angle of the bucket 15 with respect to the gravity direction G (bucket-to-ground angle) can be calculated from the bucket-to-vehicle body angle and the detection value of the vehicle body tilt angle sensor 23. For example, when it is assumed that the tilt angle is θd (see FIG. 4) and the bucket-to-vehicle body angle is θc (see FIG. 2), the tilt angle of the claw 15*c* of the bucket 15 with respect to the horizontal direction can be calculated by θd+θc. Therefore, the bucket-to-ground angle that is the tilt angle with respect to the gravity direction G can be calculated by θd+θc+90 degrees.

With the wheel loader 1 disposed on the inclined surface and the front frame 11 rotated with respect to the rear frame 12, in a case where the vehicle body tilt angle sensor 23 is disposed on the rear frame 12, the tilt angle with respect to the gravity direction G differs between at the front frame 11 and at the rear frame 12. That is, in a case where the rear frame 12 is along the inclination, the tilt angle of the rotated front frame 11 with respect to the gravity direction G may be smaller than the tilt angle of the rear frame 12 with respect to the gravity direction G. Accordingly, the detection value of the articulation angle sensor 24 is used to adjust the detection value of the vehicle body tilt angle sensor 23, whereby the bucket-to-ground angle can be calculated more accurately.

(Vehicle Body-Reference/Ground-Reference Control Determination Section 33)

The vehicle body-reference/ground-reference control determination section 33 determines whether to execute a ground-reference control or a vehicle body-reference control. A target value set by the operator in the target value setting section 52 is input to the vehicle body-reference/ground-reference control determination section 33.

Figure 7B:
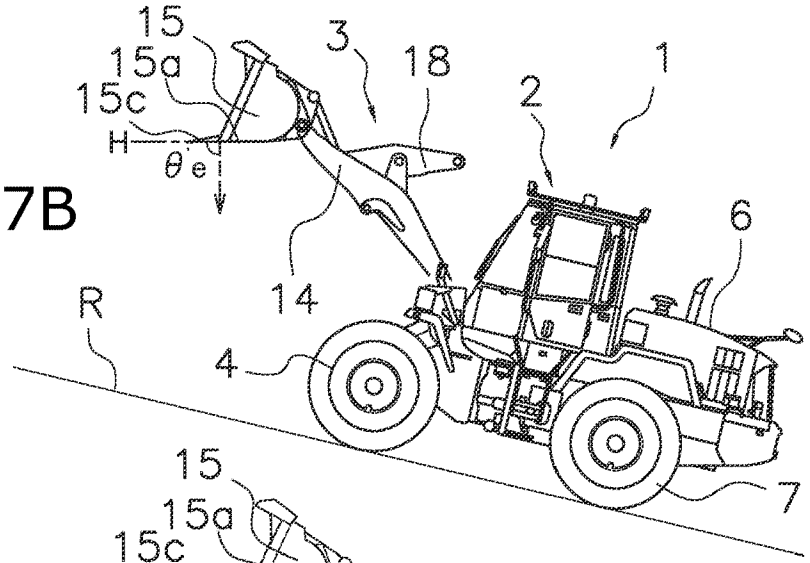
FIG. 7B is a side view illustrating a state of the bucket in a ground-reference control with the wheel loader disposed on an inclined surface.
Figure 7C:
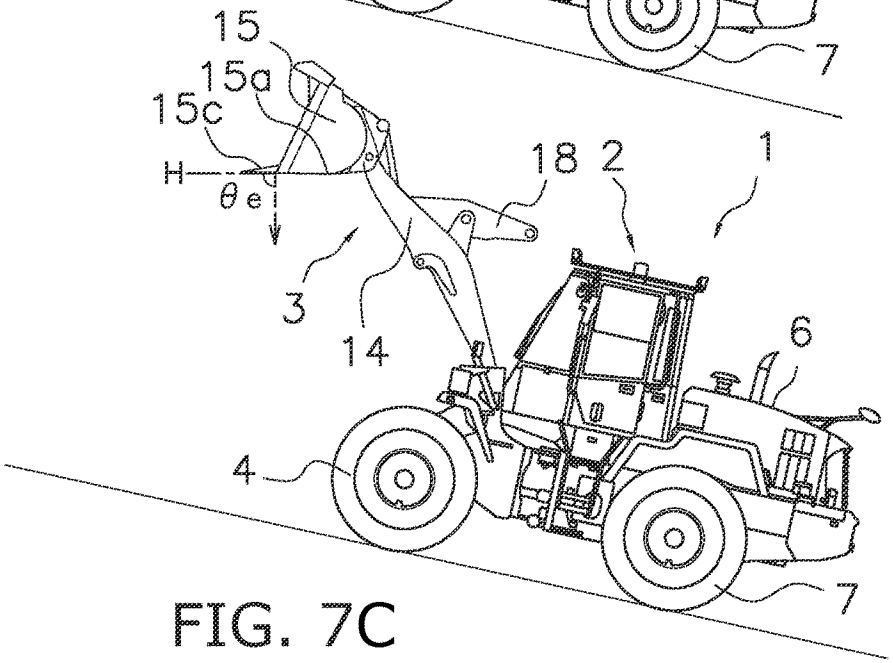
FIG. 7C is a side view illustrating a state of the bucket in a vehicle body-reference control with the wheel loader disposed on the inclined surface.
Figure 7A:
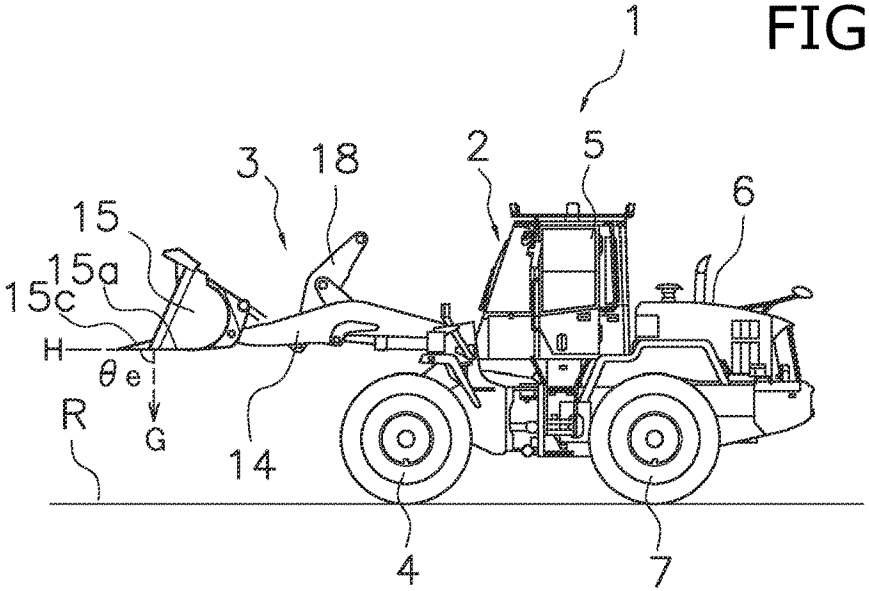
FIG. 7A is a side view of the wheel loader disposed on a horizontal surface.
Figure 8:
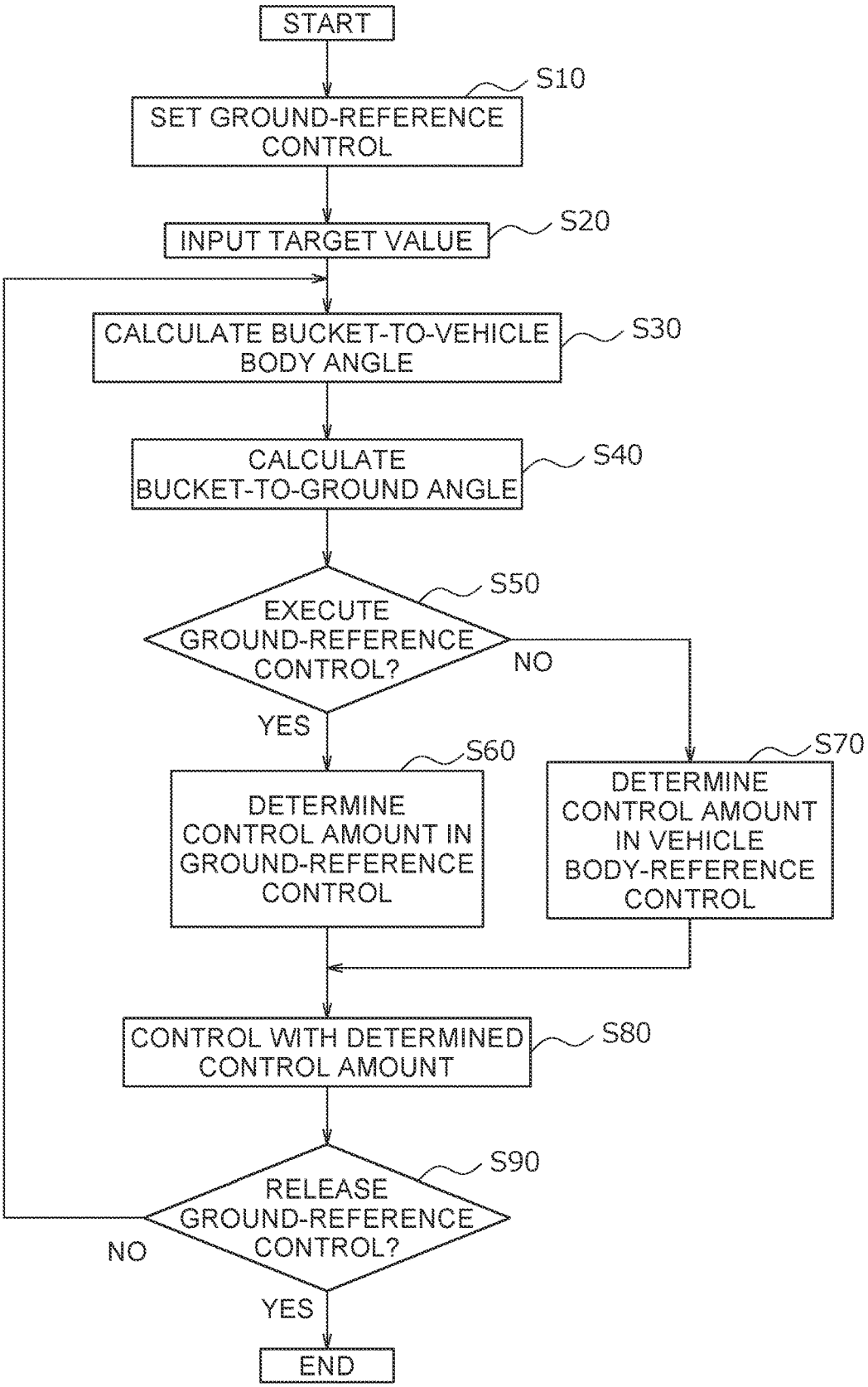
FIG. 8 is a flowchart illustrating a control operation of the wheel loader in the first embodiment according to the present disclosure.

FIGS. 7A to 7C are views for explaining the vehicle body-reference control and the ground-reference control.

As illustrated in FIG. 7A, a rotation angle of the bucket 15 is set so that the claw 15*c* is horizontally disposed in a state the wheel loader 1 is disposed on a horizontal surface.

The ground-reference control is to control so that the bucket 15 is maintained at a desired angle with respect to the gravity direction G, and the bucket 15 can be maintained at the desired angle with respect to the gravity direction G regardless of the inclination of the ground on which the wheel loader 1 is disposed. Therefore, as illustrated in FIG. 7B, even in a case where the wheel loader 1 is disposed on an inclined surface and the boom 14 rotates upward, the bottom surface 15*a* of the bucket 15 is maintained at a constant angle with respect to the gravity direction G. In the example illustrated in FIG. 7B, the constant angle is an angle at which the bottom surface 15*a* of the bucket 15 and the horizontal surface are parallel to each other. Further, the angle of the bucket 15 with respect to the gravity direction G does not have to be determined using the bottom surface 15*a* as a reference and may be determined using a configuration that forms either a line segment or a vector in the bucket 15 as a reference.

On the other hand, the vehicle body-reference control is to control so that the bucket 15 is maintained at a desired angle with respect to the vehicle body 2, and the angle of the bucket 15 with respect to the vehicle body 2 can be maintained constant. However, as illustrated in FIG. 7C, when the boom 14 rotates, the angle with respect to the gravity direction G changes depending on the inclination of the ground on which the wheel loader 1 is disposed. Therefore, in FIG. 7C, the bucket 15 is disposed at an angle which the claw 15*c* faces upward with respect to the horizontal.

The vehicle body-reference/ground-reference control determination section 33 executes the ground-reference control when a posture of the work implement 3 taken to match the bucket-to-ground angle of the bucket 15 to the target value is outside or away from a movable limit. The vehicle body-reference/ground-reference control determination section 33 executes the vehicle body-reference control without executing the ground-reference control when the posture of the work implement 3 taken to match the bucket-to-ground angle of the bucket 15 to the target value is within or approaching the movable limit.

Information on the movable limit of the posture of the work implement 3 is stored in the control section 9. As the information on the movable limit, the control section 9 stores, for example, the rotatable range of the boom 14 and the rotatable range of the bell crank 18 at each rotation angle of the boom 14.

When the rotation angle of the boom 14 is changed by the operation of the operation lever, the vehicle body-reference/ground-reference control determination section 33 calculates the rotation angle of the bell crank 18 for maintaining the bucket-to-ground angle of the bucket 15 at the target value. Then, the vehicle body-reference/ground-reference control determination section 33 determines whether the calculated rotation angle of the bell crank 18 is within the movable range at the target rotation angle of the boom 14. When it is within the movable range, the ground-reference control is executed. When it is outside the movable range, the vehicle body-reference control is executed. In this way, the vehicle body-reference/ground-reference control determination section 33 switches between the vehicle body-reference control and the ground-reference control.

Even after switching to the vehicle body-reference control, the vehicle body-reference/ground-reference control determination section 33 can return the control to the ground-reference control in a case where the posture of the work implement 3 is outside or away from the movable limit.

(Bucket Control Amount Determination Section 34)

In a case where the ground-reference control is executed, the bucket control amount determination section 34 acquires a difference between the bucket-to-ground angle calculated by the bucket-to-ground angle calculation section 32 and the target value and determines the control amount of the bucket cylinder 17 so that the bucket-to-ground angle matches the target value. This allows the control amount to be determined so that the angle of the bucket 15 with respect to the gravity direction G is maintained at a desired angle when the boom 14 is moved up and down.

On the other hand, in a case where the vehicle body-reference control is executed, the bucket control amount determination section 34 determines the control amount of the bucket cylinder 17 so as to maintain the bucket-to-vehicle body angle calculated by the bucket-to-vehicle body angle calculation section 31. This allows the control amount to be determined so that the angle of the bucket 15 with respect to the vehicle body 2 is maintained at a desired angle when the boom 14 is moved up and down.

The bucket cylinder 17 is controlled based on the control amount determined by the bucket control amount determination section 34.

<Operation>

Next, an operation of the wheel loader 1 according to an embodiment of the present invention will be described. A control method for a work machine will be described at the same time.

First, in step S10, the ground-reference control is set by the operator. The operator sets the execution of the ground-reference control using the operation section 50 in the cab 5.

Next, in step S20, the target value of the bucket-to-ground angle set by the operator is input to the control section 9.

Next, in step S30, the bucket-to-vehicle body angle calculation section 31 calculates the angle of the bucket 15 with respect to the vehicle body 2 (bucket-to-vehicle body angle) based on the detection value of the boom angle sensor 21 and the detection value of the bell crank angle sensor 22.

Next, in step S40 (an example of an attachment tilt angle detection step), the bucket-to-ground angle calculation section 32 calculates the angle of the bucket 15 with respect to the gravity direction G (bucket-to-ground angle) based on the bucket-to-vehicle body angle, the detection value of the vehicle body tilt angle sensor 23, and the detection value of the articulation angle sensor 24.

Next, in step S50, the vehicle body-reference/ground-reference control determination section 33 determines whether to execute the ground-reference control or the vehicle body-reference control. The vehicle body-reference/ground-reference control determination section 33 determines to execute the ground-reference control when the posture of the work implement 3 taken to match the bucket-to-ground angle to the input target value is outside or away from the movable limit, and the control proceeds to step S60. On the other hand, the vehicle body-reference/ground-reference control determination section 33 determines to execute the vehicle body-reference control when the posture of the work implement 3 taken to match the bucket-to-ground angle to the input target value is within or approaching the movable limit, and the control proceeds to S70.

In step S60, the bucket control amount determination section 34 acquires a difference between the bucket-to-ground angle calculated by the bucket-to-ground angle calculation section 32 and the target value and determines the control amount of the bucket cylinder 17 so that the bucket-to-ground angle matches the target value, and the control proceeds to step S80.

On the other hand, in step S70, the bucket control amount determination section 34 determines the control amount of the bucket cylinder 17 so as to maintain the bucket-to-vehicle body angle calculated by the bucket-to-vehicle body angle calculation section 31, and the control proceeds to step S80.

In step S80 (an example of a control step), the bucket cylinder 17 is controlled based on the determined control amount.

Next, in step S90, the control section 9 determines whether the setting of the ground-reference control is released by the operator. When the setting of the ground-reference control is not released by the operator, the control returns to step S30, and steps S30 to S80 are repeated. On the other hand, when the setting of the ground-reference control is released by the operator, the ground-reference control ends.

Accordingly, when the ground-reference control is set and the boom 14 is moved up and down by the operation of the operating lever, the bucket 15 can be maintained at a predetermined tilt angle with respect to the gravity direction G. Further, in a case where the work implement 3 is within or approaching the movable limit in order to maintain the bucket 15 at the target value, it is possible to switch to the vehicle body-reference control.

Second Embodiment

The wheel loader in a second embodiment will be described below. The wheel loader in the second embodiment has a different control configuration from the one in the first embodiment. Therefore, the differences will be mainly described in the second embodiment.

<Configuration>

Figure 9:
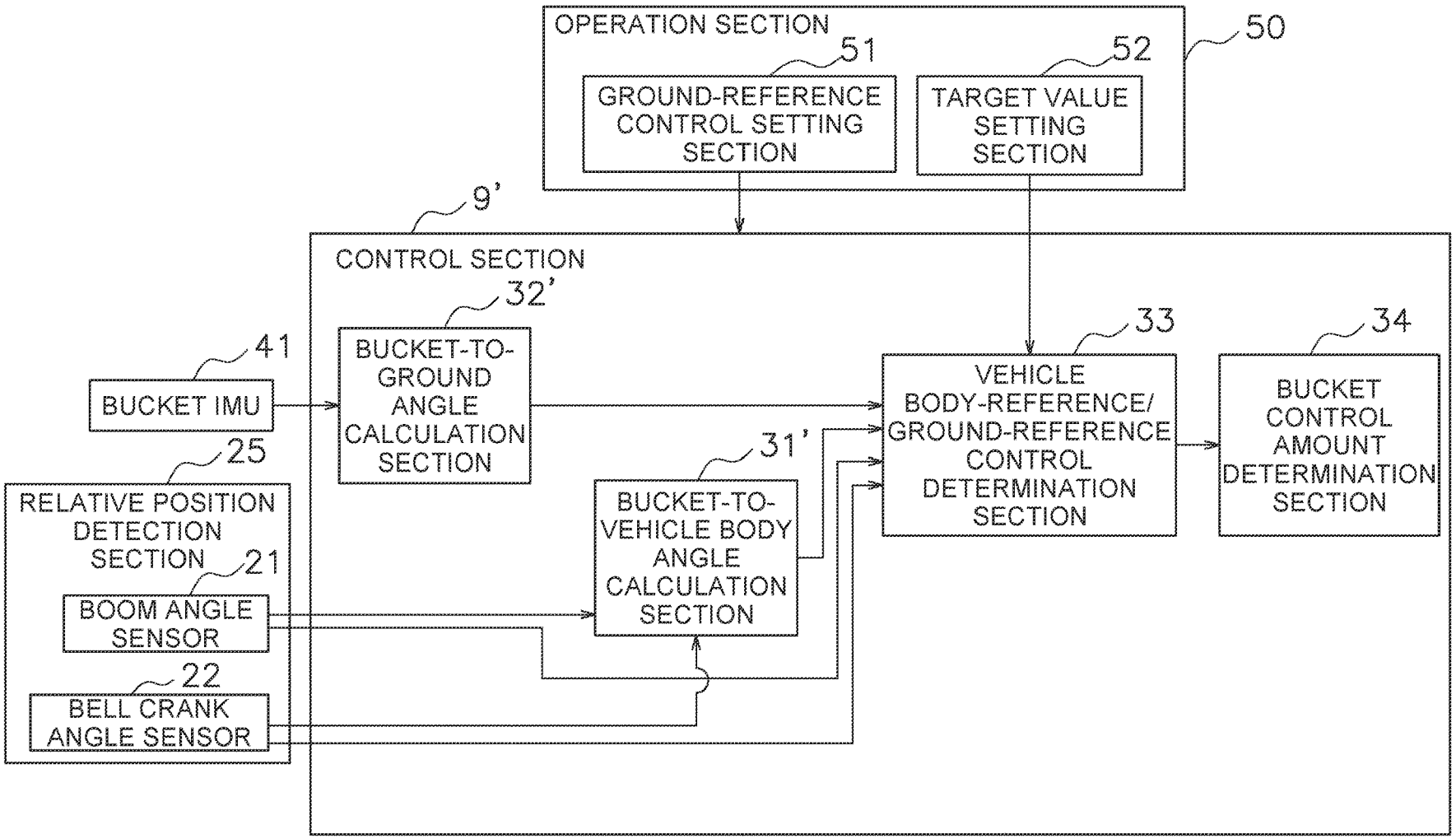
FIG. 9 is a block diagram illustrating a control configuration of the wheel loader in a second embodiment according to the present disclosure.

FIG. 9 is a block diagram illustrating a configuration of the wheel loader in the second embodiment.

Compared with the wheel loader in the first embodiment, the wheel loader in the second embodiment is not provided with the vehicle body tilt angle sensor 23 but provided with a bucket IMU 41 (an example of a bucket-to-ground angle detection section). The bucket IMU 41 is an IMU provided on the bucket 15.

The control section 9' of the wheel loader 1 in the second embodiment includes the bucket-to-vehicle body angle calculation section 31', the bucket-to-ground angle calculation section 32', the vehicle body-reference/ground-reference control determination section 33, and the bucket control amount determination section 34.

The bucket-to-ground angle calculation section 32' calculates a tilt angle of the bucket 15 with respect to the gravity direction G (bucket-to-ground angle) from a detection value of the bucket IMU 41.

The bucket-to-vehicle body angle calculation section 31' calculates an angle of the bucket 15 with respect to the vehicle body 2 (bucket-to-vehicle body angle) based on a detection value of the boom angle sensor 21 and a detection value of the bell crank angle sensor 22. A relative position of the bucket 15 with respect to the vehicle body 2 can be detected by the detection value of the boom angle sensor 21 and the detection value of the bell crank angle sensor 22. Therefore, the bucket-to-vehicle body angle can be calculated from this relative position and the bucket-to-ground angle. In a case where a boom IMU is provided on the boom 14 instead of the boom angle sensor 21 and a bell crank IMU is provided on the bell crank 18 instead of the bell crank angle sensor 22, the bucket-to-vehicle body angle calculation section 31' calculates the bucket-to-vehicle body angle based on the bucket-to-ground angle calculated by the bucket-to-ground angle calculation section 32' in addition to the detection value of the boom IMU and the detection value of the bell crank IMU.

The vehicle body-reference/ground-reference control determination section 33 and the bucket control amount determination section 34 have the same configurations as those in the first embodiment. Therefore, the descriptions thereof will be omitted.

<Operation>

Figure 10:
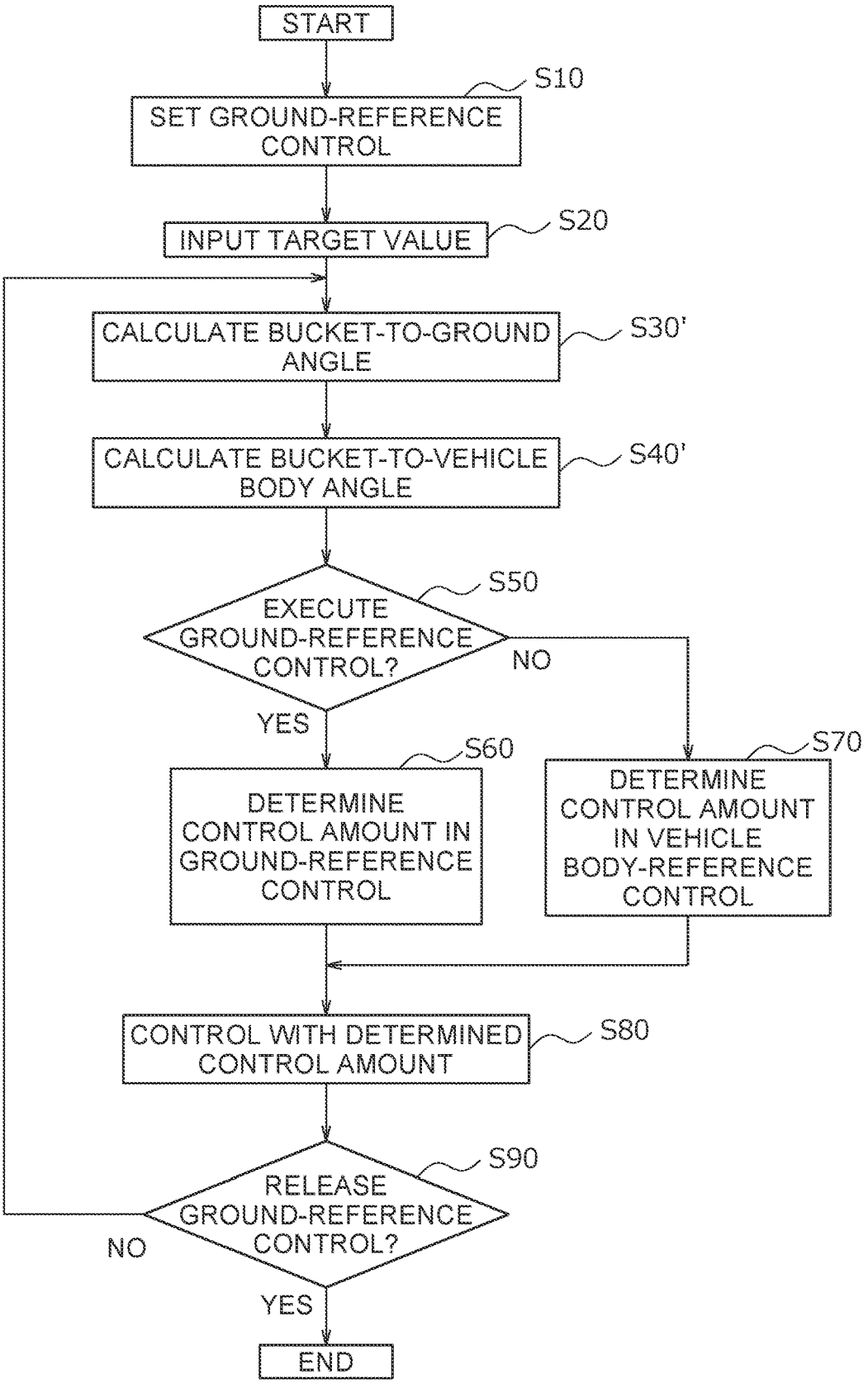
FIG. 10 is a flowchart illustrating a control operation of the wheel loader in the second embodiment according to the present disclosure.

Next, an operation of the wheel loader 1 in the second embodiment will be described, and an example of a control method for a work machine will be described at the same time. FIG. 10 is a flowchart describing the operation of the wheel loader 1 in the second embodiment.

In the second embodiment, steps S30 and S40 are different from those in the first embodiment.

In step S30' (an example of the attachment tilt angle detection step) subsequent to steps S10 and S20, the bucket-to-ground angle calculation section 32' calculates the tilt angle of the bucket 15 with respect to the gravity direction G (bucket-to-ground angle) from the detection value of the bucket IMU41.

Next, in step S40', the bucket-to-vehicle body angle calculation section 31' calculates the angle of the bucket 15 with respect to the vehicle body 2 (bucket-to-vehicle body angle) based on the detection value of the boom angle sensor 21, the detection value of the bell crank angle sensor 22, and the bucket-to-ground angle calculated by the bucket-to-ground angle calculation section 32'.

Subsequent steps S50 to S90 are the same as those in the first embodiment and the descriptions thereof are omitted.

The wheel loader 1 in the first embodiment includes the vehicle body 2, the work implement 3, the bucket-to-ground angle detection section 20, and the control section 9. The work implement 3 operates with respect to the vehicle body 2 and includes the bucket 15 or the fork 19. The wheel loader 1 in the second embodiment includes the vehicle body 2, the work implement 3, the bucket IMU 41, and the control section 9'. The work implement 3 operates with respect to the vehicle body 2 and includes the bucket 15 or the fork 19. The bucket-to-ground angle detection section 20 or the bucket IMU 41 detects information on the tilt angle of the attachment with respect to the gravity direction G. The control section 9 controls the tilt angle of the bucket 15 or the fork 19 with respect to the gravity direction G based on the detection value of the bucket-to-ground angle detection section 20. The control section 9' controls the tilt angle of the bucket 15 or the fork 19 with respect to the gravity direction G based on the detection value of the bucket IMU 41.

In this way, the information on the tilt angle of the bucket 15 or the fork 19 with respect to the gravity direction G is detected and the control is executed based on the tilt angle, whereby the tilt angle of the bucket 15 or the fork 19 can be maintained constant even when the wheel loader 1 is in the tilted state.

In the wheel loader 1 according to the first embodiment, the bucket-to-ground angle detection section 20 includes the vehicle body tilt angle sensor 23 and the relative position detection section 25. The vehicle body tilt angle sensor 23 detects the tilt angle of the vehicle body 2 with respect to the gravity direction G. The relative position detection section 25 detects the information on the relative position of the bucket 15 or the fork 19 with respect to the vehicle body 2. The control section 9 calculates the tilt angle of the bucket 15 or the fork 19 with respect to the vehicle body 2 (bucket-to-vehicle body angle) from the detection value of the relative position detection section 25 and calculates the tilt angle of the bucket 15 or the fork 19 with respect to the gravity direction G from the calculated bucket-to-vehicle body angle and the detection value of the vehicle tilt angle sensor 23.

In this way, the tilt angle of the bucket 15 or the fork 19 with respect to the gravity direction G can be calculated from the relative position of the bucket 15 or the fork 19 with respect to the vehicle body 2 and the tilt angle of the vehicle body 2 with respect to the gravity direction G.

In the wheel loader 1 according to the first embodiment, the work implement 3 further includes the boom 14 that is rotatably connected to the vehicle body 2. The bucket 15 or the fork 19 is rotatably connected to the boom 14. The relative position detection section 25 includes the boom angle sensor 21 and the bell crank angle sensor 22. The boom angle sensor 21 detects the information on the rotation angle of the boom 14. The bell crank angle sensor 22 detects the information on the rotation angle of the bucket 15 or the fork 19. The control section 9 calculates the tilt angle of the bucket 15 or the fork 19 with respect to the vehicle body 2 by using the detection value of the boom angle sensor 21 and the detection value of the bell crank angle sensor 22.

In this way, the relative position of the bucket 15 or the fork 19 with respect to the vehicle body 2 can be specified by the information on the rotation angle of the boom 14 and the information on the rotation angle of the bucket 15 or the fork 19.

In the wheel loader 1 according to the first embodiment, the control section 9 executes the control based on the tilt angle of the bucket 15 or the fork 19 with respect to the vehicle body 2 or the control based on the tilt angle of the bucket 15 or the fork 19 with respect to the gravity direction G, based on the detection value of the bucket-to-ground angle detection section 20.

Accordingly, it is possible to execute either the control based on the relative tilt angle of the bucket 15 or the fork 19 with respect to the vehicle body 2 or the control based on the tilt angle of the bucket 15 or the fork 19 with respect to the gravity direction G.

For example, when it is determined that the control based on the tile angle of the bucket 15 or the fork 19 with respect to the gravity direction G cannot be executed with the posture of the work implement 3 acquired from the rotation angle of the bucket 15 or the fork 19 and the rotation angle of the boom 14, it is possible to switch to the control based on the tilt angle of the bucket 15 or the fork 19 with respect to the vehicle body 2.

In the wheel loader 1 according to the first embodiment, the work implement 3 further includes the boom 14 that is rotatably connected to the vehicle body 2. The bucket 15 or the fork 19 is rotatably connected to the boom 14. The control section 9 maintains the tilt angle of the bucket 15 or the fork 19 with respect to the gravity direction G constant when the boom 14 is raised. This allows the angle of the bucket 15 or the fork 19 with respect to the gravity direction G to be maintained constant, for example, when the boom 14 is raised while the wheel loader 1 travels upward on an inclined surface.

In the wheel loader 1 according to the first embodiment, the vehicle body 2 includes the front frame 11, the rear frame 12, the front tires 4, and the rear tires 7. The work implement 3 is connected to the front frame 11. The rear frame 12 is disposed behind the front frame 11. The front tires 4 are provided on the front frame 11. The rear tires 7 are provided on the rear frame 12. The wheel loader 1 further includes the articulation angle sensor 24 that detects the rotation angle of the front frame 11 with respect to the rear frame 12. The control section 9 controls the tilt angle of the bucket 15 or the fork 19 with respect to the gravity direction G based on the detection value of the bucket-to-ground angle detection section 20 and the detection value of the articulation angle sensor 24.

When the front frame 11 rotates with respect to the rear frame 12 with the wheel loader 1 disposed on an inclined surface, the tilt angle of the bucket 15 or the fork 19 with respect to the gravity direction G may deviate from the inclined surface. Therefore, the detection value of the bucket-to-ground angle detection section 20 is adjusted with the articulation angle, whereby the tilt angle of the bucket 15 or the fork 19 with respect to the gravity direction G can be calculated more accurately.

The wheel loader 1 in the second embodiment further includes the relative position detection section 25. The relative position detection section 25 detects the relative position of the bucket 15 or the fork 19 with respect to the vehicle body 2. The control section 9' controls the tilt angle of the bucket 15 or the fork 19 with respect to the gravity direction G based on the detection value of the IMU 41 and the detection value of the relative position detection section 25.

Accordingly, the tilt angle of the bucket 15 or the fork 19 with respect to the gravity direction G can be controlled based on the detection value of the bucket-to-ground angle detection section 20 and the detection value of the relative position detection section 25.

In the wheel loader 1 in the first embodiment, the control section 9 executes the control so that the tilt angle of the bucket 15 or the fork 19 with respect to the gravity direction G is a predetermined angle. In the wheel loader 1 in the second embodiment, the control section 9' executes the control so that the tilt angle of the bucket 15 or the fork 19 with respect to the gravity direction G is a predetermined angle.

Accordingly, it is possible to execute the control so that the angle of the bucket 15 or the fork 19 with respect to the gravity direction G is constant.

The control method for the wheel loader 1 according to the first and second embodiments is the control method for the wheel loader 1 that includes the vehicle body 2, the work implement 3 operating with respect to the vehicle body 2 and having the bucket 15 or the fork 19, and the control method includes step S40 or step S30' (an example of the attachment tilt angle detection step) and step S80 (an example of the control step). Step S40 or step S30' acquires the tilt angle of the bucket 15 or the fork 19 with respect to the gravity direction G. Step S80 controls the tilt angle of the bucket 15 or the fork 19 with respect to the direction of gravity G based on the detected value acquired in step S40 or step S30'.

Although embodiments of the present invention have been described so far, the present invention is not limited to the above embodiments and various modifications can be made without departing from the gist of the invention.

In the first and second embodiments, the vehicle body-reference/ground-reference control determination section 33 is provided and the control is automatically switched. However, when it is determined that the ground-reference control is not executed, the operator may determine whether to execute the vehicle body-reference control.

In the first and second embodiments, the ground-reference control setting section 51 is provided in the operation section 50, but a vehicle body-reference control setting section for setting the execution of the vehicle body-reference control may be further provided.

In the first and second embodiments, the vehicle body-reference/ground-reference control determination section 33 is provided and the control is switched to the vehicle body-reference control when the posture of the work implement 3 taken to match the angle of the bucket 15 with respect to the ground to the set target value is within or approaching the movable limit. In this case, however, the control may end without switching.

That is, the control section 9, 9' stops the control of the tilt angle of the attachment with respect to the gravity direction G based on the detection value of the boom angle sensor 21 and the detection value of the bell crank angle sensor 22.

Accordingly, when it is determined that the control based on the tilt angle of the bucket 15 or the fork 19 with respect to the gravity direction G cannot be executed with the posture of the work implement 3 acquired from the rotation angle of the bucket 15 or the fork 19 and the rotation angle of the boom 14, it is possible to stop the control.

In addition, a warning may be displayed to the operator. The warning display can be provided in the cab 5.

In the first embodiment, since the vehicle body tilt angle sensor 23 is provided on the rear frame 12, the vehicle body tilt angle sensor 23 is adjusted by the articulation angle sensor 24. However, in a case where the vehicle body tilt angle sensor 23 is provided on the front frame 11, the articulation angle sensor 24 may not be provided. In this case, it is more preferable that the vehicle body tilt angle sensor 23 is disposed on the front frame 11 in the vicinity of the work implement 3.

In the first and second embodiments, the boom angle sensor 21 and the bell crank angle sensor 22 are provided as the relative position detection section 25, but the relative position detection section 25 is not limited to them. For example, instead of the bell crank angle sensor 22, the rotation angle of the bucket 15 with respect to the boom 14 may be detected by a sensor, and its detection value and the detection value of the boom angle sensor 21 may be used to calculate the bucket-to-vehicle body angle.

In the second embodiment, the boom angle sensor 21 and the bell crank angle sensor 22 are provided as the relative position detection section 25, but the relative position detection section 25 is not limited to them. As long as any two of the boom angle sensor 21, the bell crank angle sensor 22, or the vehicle body tilt angle sensor 23 are provided, the relative position of the bucket 15 with respect to the vehicle body 2 can be specified. Therefore, the bucket-to-vehicle body angle is calculated, whereby it is possible to determine whether to execute the vehicle body-reference control or the ground-reference control. Further, the vehicle body tilt angle sensor 23 may be combined with the articulation angle sensor 24.

The work machine and the control method for the work machine in the present invention have the effect of maintaining the angle of the attachment even in the tilted state and are useful in a hydraulic excavator, a wheel loader, or the like.

The invention claimed is:

1. A wheel loader comprising:

a body including a front frame to which a work implement is connected, the work implement being movably attached to the front frame and including an attachment, a rear frame disposed behind the front frame, front tires disposed on the front frame, and rear tires disposed on the rear frame;

a plurality of sensors, the plurality of sensors being configured to detect information on an attachment-to-ground angle of the attachment with respect to a gravity direction, the plurality of sensors being further configured to detect an articulation angle of the front frame with respect to the rear frame; and a controller including a processor and a storage, the controller being configured to calculate the attachment-to-ground angle by adjusting the information on the attachment-to-ground angle in accordance with the articulation angle, the controller being configured to control the attachment-to-ground angle based on a detection value from the plurality of sensors such that the attachment-to-ground angle matches a target value, the controller being configured to determine whether a posture of the work implement required to match the attachment-to-ground angle to the target value is within a moveable range of the work implement, the controller being configured to execute a ground-reference control such that the attachment-to-ground angle is maintained constant at the target value when the posture of the work implement required to match the attachment-to-ground angle to the target value is within the movable range, and the controller being configured to execute a vehicle-body-reference control such that an attachment-to-body angle of the attachment with respect to the body is maintained constant when the posture of the work implement required to match the attachment-to-ground angle to the target value is outside the movable range.

2. The wheel loader according to claim 1, wherein the plurality of sensors is configured to detect a body tilt angle of the body with respect to the gravity direction, and detect information on a relative position of the attachment with respect to the body, and the controller is configured to calculate the attachment-to-body angle from the information on the relative position and calculate the attachment-to-ground angle from the attachment-to-body angle and the body tilt angle.

3. The wheel loader according to claim 2, wherein the work implement further includes a boom that is rotatably connected to the body, the attachment is rotatably connected to the boom, the plurality of sensors is configured to detect information on a rotation angle of the boom, and detect information on a rotation angle of the attachment, and the controller is configured to calculate the attachment-to-body angle using the information on the rotation angle of the boom and the information on the rotation angle of the attachment.

4. The wheel loader according to claim 1, wherein the work implement further includes a boom that is rotatably connected to the body, the attachment is rotatably connected to the boom, and the controller is configured to maintain the attachment-to-ground angle constant at the target value when the boom is raised.

5. The wheel loader according to claim 1, wherein the plurality of sensors is further configured to detect a relative position of the attachment with respect to the body, and the controller is configured to control the attachment-to-ground angle based on the information on the attachment-to-ground angle and the relative position of the attachment with respect to the body.

6. A control method for a work machine that includes a body and a work implement that has an attachment and is movably attached to the body, the body including a front frame to which the work implement is connected, a rear frame disposed behind the front frame, front tires disposed on the front frame, and rear tires disposed on the rear frame, the control method comprising using a controller and a plurality of sensors to perform the following:

detecting information on an attachment-to-ground angle of the attachment with respect to a gravity direction;

detecting an articulation angle of the front frame with respect to the rear frame, calculating the attachment-to-ground angle by adjusting the information on the attachment-to-ground angle in accordance with the articulation angle;

controlling the attachment-to-ground angle such that the attachment-to-ground angle matches a target value;

determining whether a posture of the work implement required to match the attachment-to-ground angle to the target value is within a moveable range of the work implement;

executing a ground-reference control such that the attachment-to-ground angle is maintained constant at the target value when the posture of the work implement required to match the attachment-to-ground angle to the target value is within the movable range; and executing a vehicle-body-reference control such that an attachment-to-body angle of the attachment with respect to the body is maintained constant when the posture of the work implement required to match the attachment-to-ground angle to the target value is outside the movable range.

* * * * *